US011350731B2

(12) United States Patent
Linne

(10) Patent No.: US 11,350,731 B2
(45) Date of Patent: Jun. 7, 2022

(54) HOSE ATTACHMENT

(71) Applicant: David Linne, Charlevoix, MI (US)

(72) Inventor: David Linne, Charlevoix, MI (US)

( * ) Notice: Subject to any disclaimer, the term of this patent is extended or adjusted under 35 U.S.C. 154(b) by 0 days.

(21) Appl. No.: 17/325,781

(22) Filed: May 20, 2021

(65) Prior Publication Data

US 2021/0361058 A1 Nov. 25, 2021

Related U.S. Application Data

(60) Provisional application No. 63/028,499, filed on May 21, 2020.

(51) Int. Cl.
*A46B 11/06* (2006.01)
*B05B 15/65* (2018.01)

(52) U.S. Cl.
CPC ..... *A46B 11/063* (2013.01); *B05B 15/65* (2018.02); *A46B 11/06* (2013.01)

(58) Field of Classification Search
CPC ..... A46B 11/063; A46B 11/00; A46B 11/06; A46B 11/066; A46B 11/0072; B05B 15/65; B05B 15/60; B05B 15/654
USPC ..... 401/289, 282, 286, 290
See application file for complete search history.

(56) References Cited

U.S. PATENT DOCUMENTS 612,711 A * 10/1898 Dever
2,825,079 A * 3/1958 Shey ..... A46B 11/063 401/136
5,702,195 A * 12/1997 Rittenbaum ..... A46B 11/06 401/268
6,270,278 B1 * 8/2001 Mauro ..... A46B 11/063 401/289

* cited by examiner

*Primary Examiner* — David J Walczak
(74) *Attorney, Agent, or Firm* — Intellectual Property Consulting, LLC; Mark Melasky

(57) ABSTRACT

An attachment for use with a hose. The attachment includes a body having a proximal end opposite a distal end. The body defines an inlet disposed at the proximal end. The body further defines an outlet at the distal end. The body defines an inner flow passage operable to enable water to flow from the inlet to the outlet. A connector is disposed at the proximal end of the body and is operable for attachment to a water source. A plurality of bristles is disposed at the distal end of the body and is operable for scrubbing a surface.

1 Claim, 4 Drawing Sheets

HOSE ATTACHMENT

CROSS REFERENCE TO RELATED APPLICATIONS

This application claims priority to U.S. Provisional Patent Application No. 63/028,499, filed May 21, 2020, the entirety of which is incorporated by reference as if fully disclosed herein.

BACKGROUND OF THE INVENTION

Field of the Invention

The present invention relates generally to attachments for garden hoses.

General Background

Garden hoses are used for a myriad of reasons such as watering plants, filling a bucket, etc. But more often than not users reach for the garden hose to clean something. Most times a quick rinse is the intention—just pick up the hose and aim. Water is sprayed to wash away bird droppings, spider dots, brake dust on car wheels, and footprints, for example. But many of these messy problems do not wash away with water spray alone and require some scrubbing. Therefore, a need exists for an apparatus that eliminates the time required to acquire a brush and enable a user to quickly scrub a surface.

SUMMARY OF THE INVENTION

In accordance with an embodiment of the invention, an attachment for use with a hose is provided. The attachment includes a body having a proximal end opposite a distal end. The body defines an inlet disposed at the proximal end. The body further defines an outlet at the distal end. The body defines an inner flow passage operable to enable water to flow from the inlet to the outlet. A connector is disposed at the proximal end of the body and is operable for attachment to a water source. A plurality of bristles is disposed at the distal end of the body and is operable for scrubbing a surface.

In accordance with another embodiment of the invention, an attachment for use with a hose is provided. The attachment includes a body having a proximal end opposite a distal end. The body defines an inlet disposed at the proximal end. The body further defines an outlet at the distal end. The body defines an inner flow passage operable to enable water to flow from the inlet to the outlet. A connector is disposed at the proximal end of the body and is operable for attachment to a water source. Means for scrubbing a surface is disposed at the distal end of the body.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein.

Figure 1:
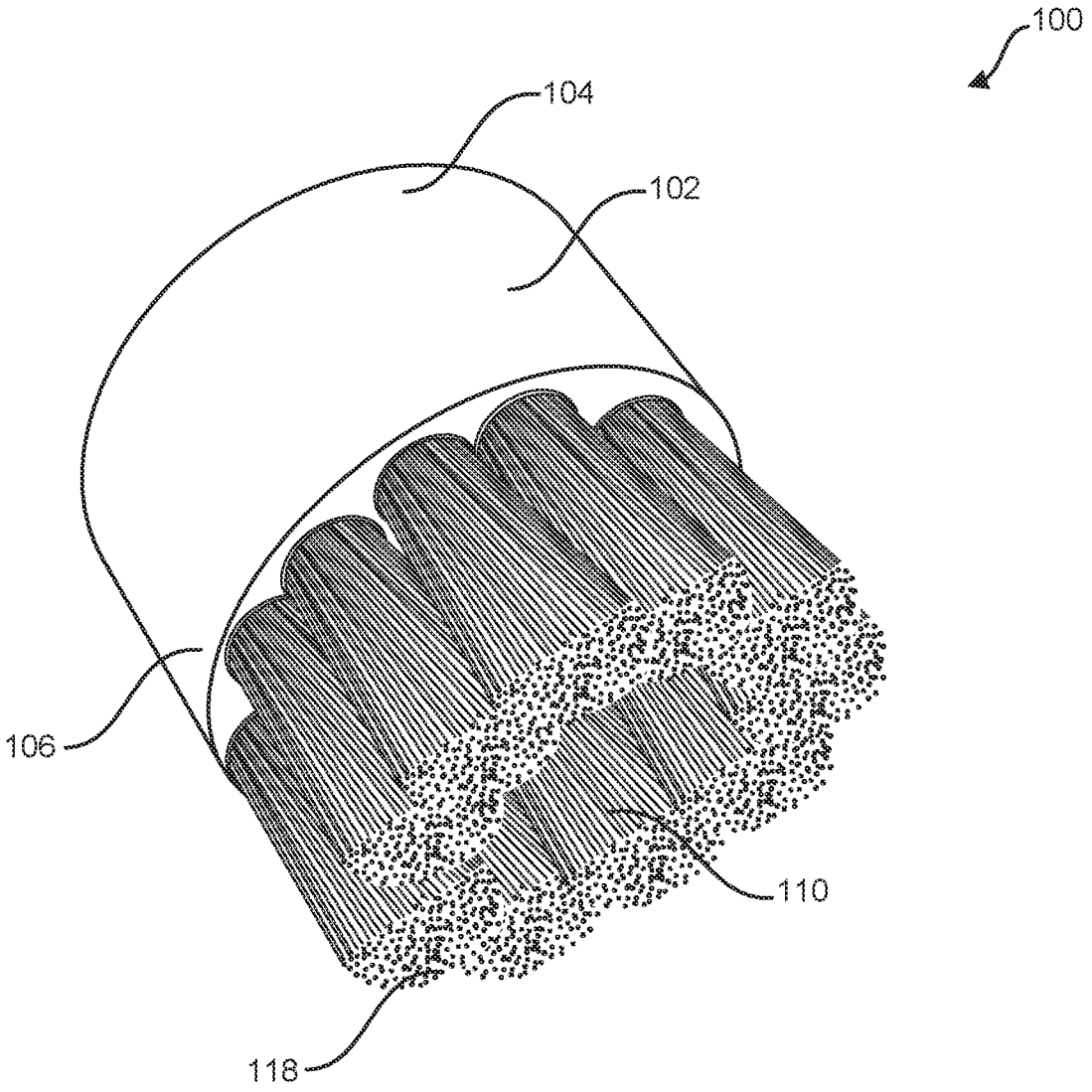
FIG. 1 depicts a front perspective view of a hose attachment in accordance with embodiments of the invention.
Figure 2:
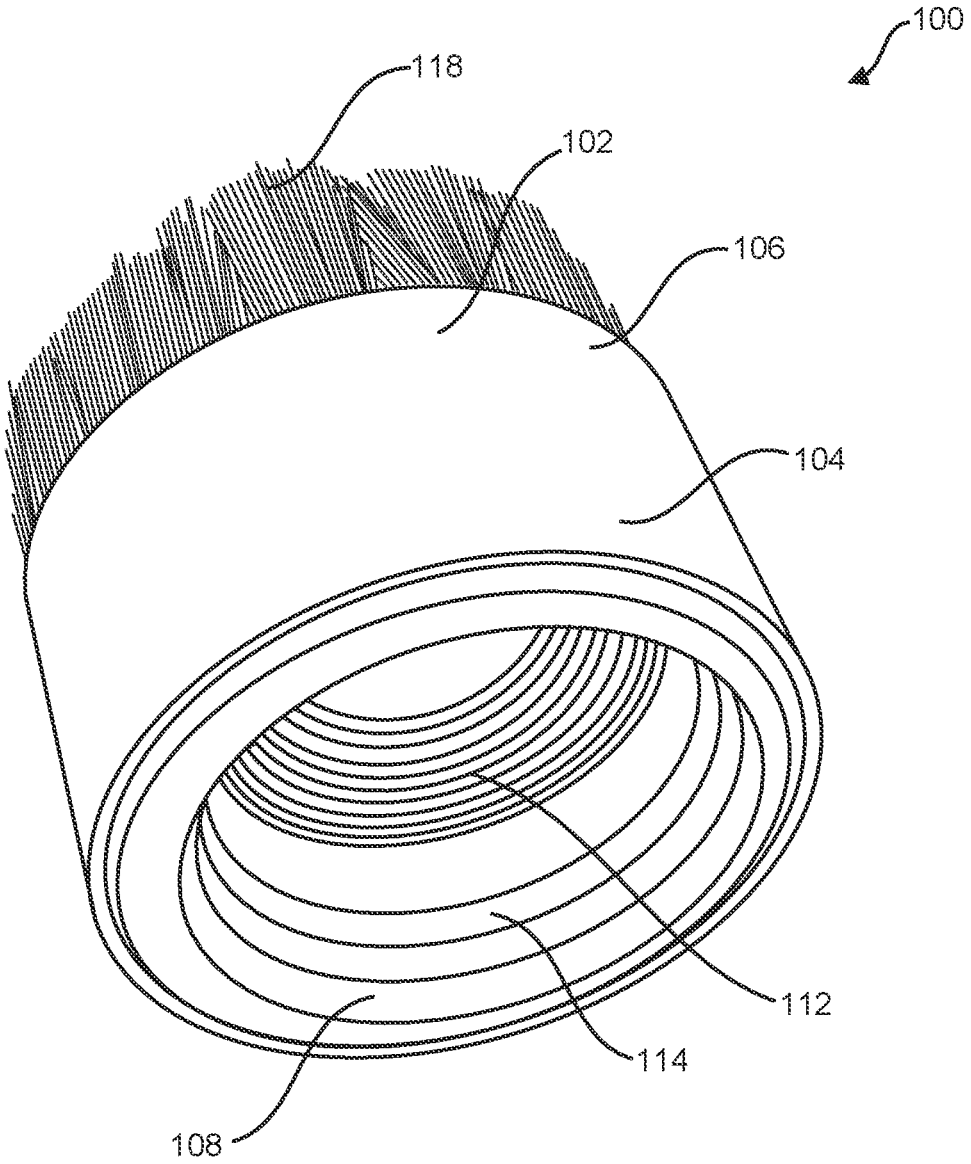
FIG. 2 depicts a back perspective view of a hose attachment in accordance with embodiments of the invention.
Figure 3:
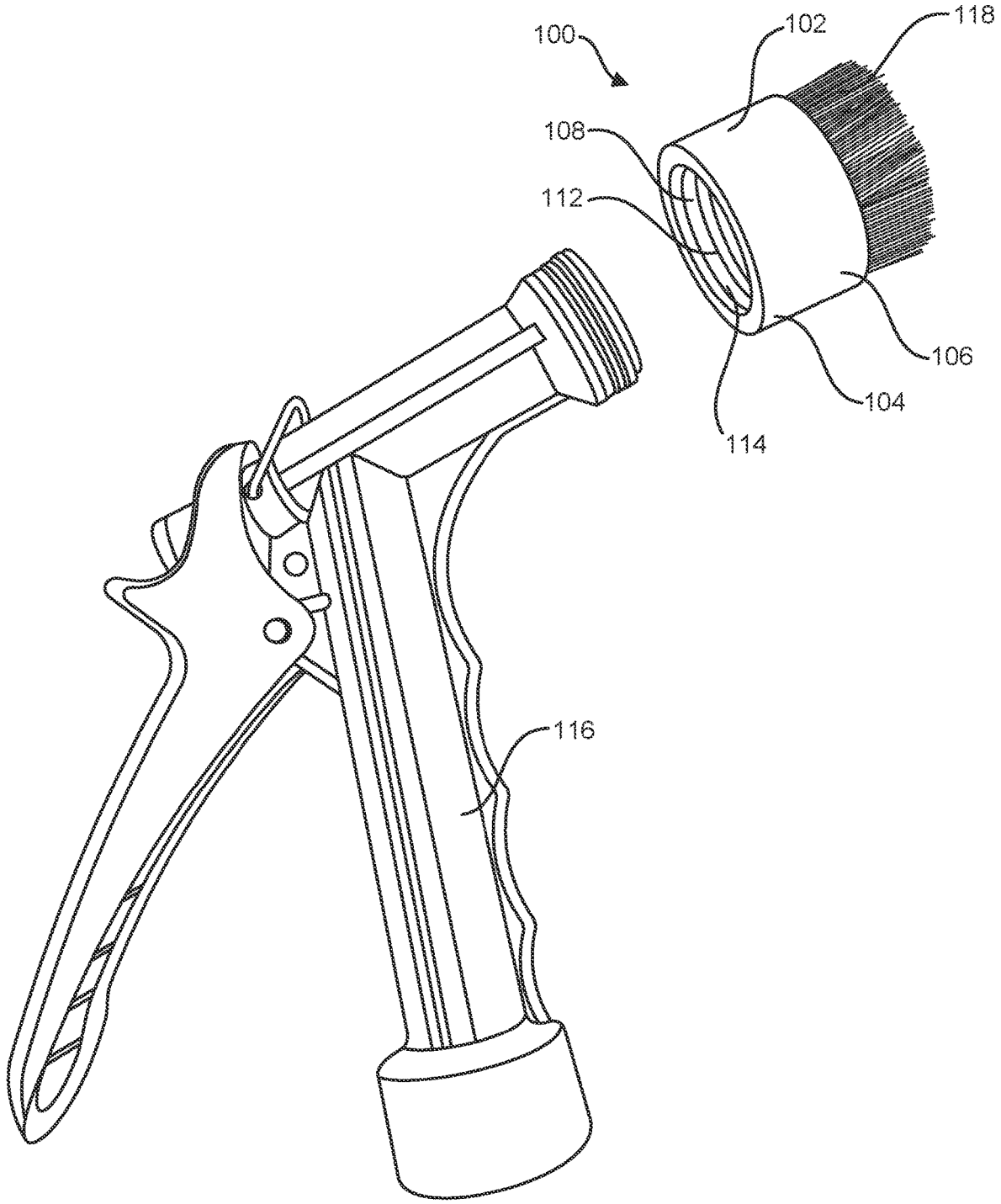
FIG. 3 depicts a side perspective view of a hose attachment and a hose nozzle in accordance with embodiments of the invention.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

The embodiments of the disclosure will be best understood by reference to the drawings, wherein like parts are designated by like numerals throughout. It will be readily understood that the components, as generally described and illustrated in the Figures herein, could be arranged and designed in a wide variety of different configurations or be entirely separate. Thus, the following more detailed description of the embodiments of the system and method of the disclosure, as represented in the Figures is not intended to limit the scope of the disclosure, as claimed, but is merely representative of possible embodiments of the disclosure.

Figure 4:
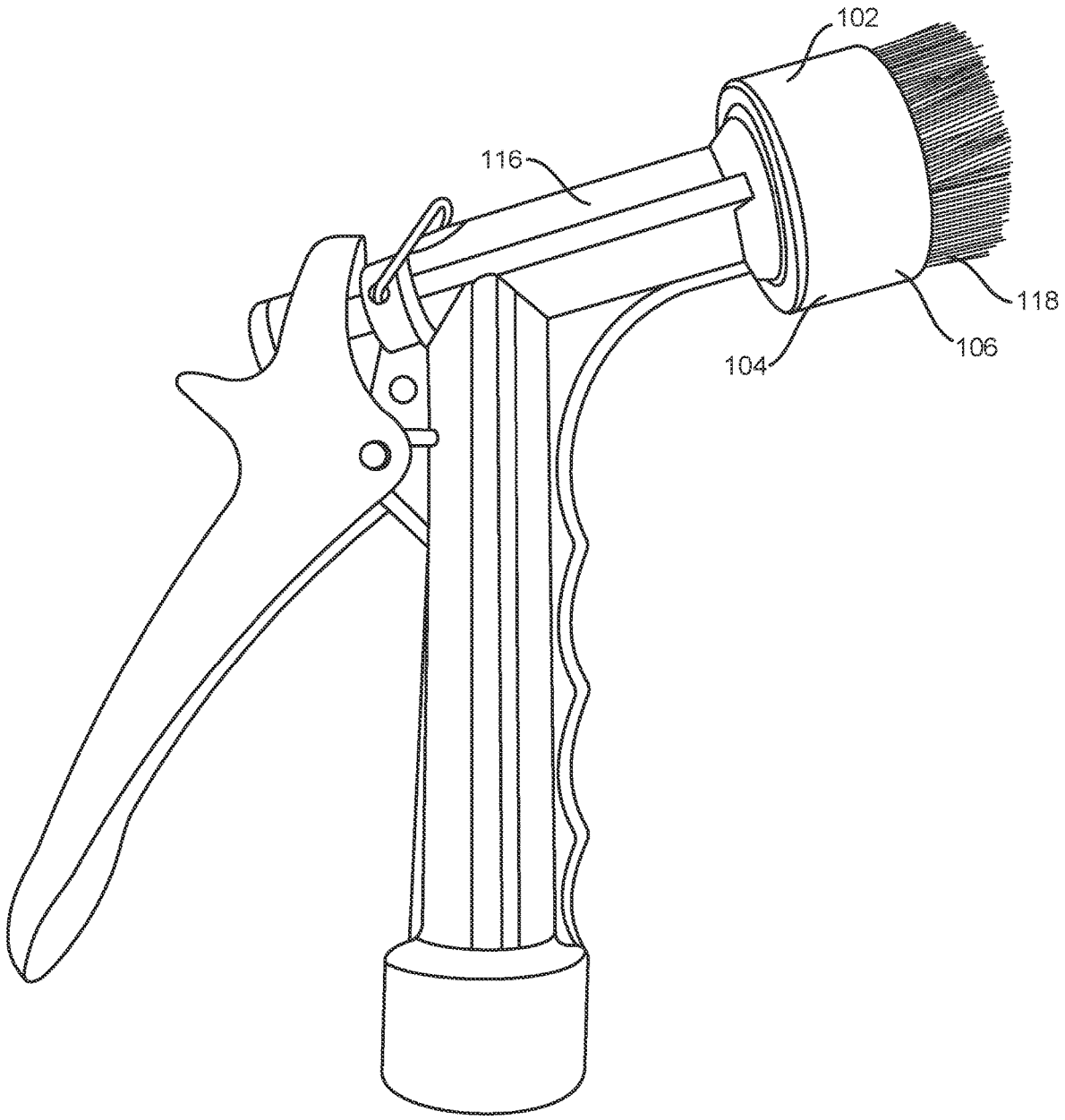
FIG. 4 depicts a side perspective view of a hose attachment attached to a hose nozzle in accordance with embodiments of the invention.

In accordance with embodiments of the invention, a hose attachment 100 is provided, as illustrated in FIGS. 1-4. The attachment 100 includes a body 102 having a proximal end 104 opposite a distal end 106. The body 102 defines an inlet 108 disposed at the proximal end 104 of the body 102. The body 102 may be fabricated of plastic injection molding, cast metal, machined metal, or 3D printed materials, for example. The body 102 defines an outlet 110 at the distal end 106 of the body 102. The body 102 defines an inner flow passage 112 operable to enable water to flow unimpeded from the inlet 108 to the outlet 110. A connector 114 is disposed at the proximal end 104 of the body 102 and is operable for attachment to a water source. As illustrated in the Figures, the connector 114 is a threaded connection operable for attachment to a garden hose or a nozzle, such as a trigger flow control nozzle 116, as illustrated in FIGS. 4 and 5, for example. Alternatively, the connector 114 may be a push on connector with a gasket, a quick connect attachment, or any suitable connection mechanism operable for a fluid tight connection to a hose or nozzle. As illustrated in the Figures, means for contacting a surface to clean or scrub the surface is a plurality of bristles 118, such as nylon bristles, is disposed at the distal end 106 of the body 102 and is operable for scrubbing a surface. Alternatively, the means for contacting a surface to clean or scrub the surface may be a brush, steel wool, a sponge, shammy cloth, sandpaper, chainmail, or any other suitable means for contacting, cleaning, or abrading a surface. The means for contacting the surface may be integrated within the body 102, such as the bristles 118 as illustrated in the Figures, or fastened to the body 102, for example.

In operation of the embodiment illustrated in the Figures, the attachment 100 is operable to screw onto threaded hose nozzles without impeding the water flow or adding significant weight. The attachment 100 avoids the need for a user to search for a brush when using a hose and encountering a surface that needs scrubbing for removing a hardened substance. Exemplary applications include cleaning deck furniture, railings, windows, window casings, boats, yachts, and automobiles, for example.

An advantage of the attachment 100 is the non-interference with normal use of a hose. Unlike prior art hose attachments, which burden the hose and the user with attaching and detaching, the attachment 100 does not have to be removed in order to use the hose as a user normally would. Water distribution is unimpeded when the attachment 100 is connected. When the need arises to scrub something, the attachment 100 is attached and ready to use.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. An attachment for use with a hose consisting of:

a one-piece integrally formed plastic cylindrical body having a flat proximal end surface, an opposite flat distal end surface and a side surface extending between the flat proximal end surface and flat distal end surface wherein the side surface of the cylindrical body has a constant diameter from the flat proximal end surface to the flat distal end surface, the cylindrical body defining an inner flow passage therethrough from an inlet in the flat proximal end surface to an outlet in the flat distal end surface;

a threaded connector disposed within the flow passage adjacent the flat proximal end surface of the cylindrical body, the threaded connector adapted to be threadedly attached to a threaded end of a garden hose or a threaded end of a trigger flow control nozzle attached to a garden hose such that water may flow from the garden hose, through the flow passage and out of the outlet; and a plurality of bristles disposed on the flat distal end surface of the cylindrical body wherein the bristles are arranged outside of a periphery of the outlet such the bristles do not interfere with water exiting the outlet wherein the bristles are operable for scrubbing a surface.

* * * * *